US008558760B2

(12) United States Patent
Vitunic et al.

(10) Patent No.: US 8,558,760 B2
(45) Date of Patent: Oct. 15, 2013

(54) CIRCUITRY AND METHODOLOGY FOR DRIVING MULTIPLE LIGHT EMITTING DEVICES

(75) Inventors: Mark Robert Vitunic, Lexington, MA (US); Steven Leo Martin, Lowell, MA (US)

(73) Assignee: Linear Technology Corporation, Milpitas, CA (US)

( * ) Notice: Subject to any disclaimer, the term of this patent is extended or adjusted under 35 U.S.C. 154(b) by 3070 days.

(21) Appl. No.: 10/911,703

(22) Filed: Aug. 5, 2004

(65) Prior Publication Data

US 2006/0028150 A1 Feb. 9, 2006

(51) Int. Cl.
*G09G 3/14* (2006.01)

(52) U.S. Cl.
USPC ..... 345/46; 345/211; 345/212; 345/213; 345/214

(58) Field of Classification Search
USPC ..... 345/46, 47, 211–214
See application file for complete search history.

(56) References Cited

U.S. PATENT DOCUMENTS

| | | | | |
|---|---|---|---|---|
| 6,166,527 | A | 12/2000 | Dwelley et al. | |
| 6,404,251 | B1 | 6/2002 | Dwelley et al. | |
| 6,617,801 | B2 | 9/2003 | Ishizuka et al. | |
| 6,822,403 | B2 | 11/2004 | Horiuchi et al. | |
| 6,836,157 | B2 * | 12/2004 | Rader et al. | 327/66 |
| 6,940,733 | B2 * | 9/2005 | Schie et al. | 363/21.12 |
| 7,365,718 | B2 | 4/2008 | Tsuchida et al. | |
| 2004/0105283 | A1 | 6/2004 | Schie et al. | |
| 2004/0208011 | A1 | 10/2004 | Horiuchi et al. | |
| 2005/0225515 | A1 * | 10/2005 | Tsuchida et al. | 345/76 |

FOREIGN PATENT DOCUMENTS

| | | |
|---|---|---|
| JP | 2002-351399 | 12/2002 |
| JP | 2003-332624 | 11/2003 |
| JP | 2004-006533 | 1/2004 |
| JP | 2004-085751 | 3/2004 |
| WO | WO 03/103061 A1 | 12/2003 |

OTHER PUBLICATIONS

Chinese Office Action, w/ English translation thereof, issued in Chinese Patent Application No. CN 200510089179.3 dated on Jun. 20, 2008.

Linear Technology LTC3440 Micropower Synchronous Buck-Boost DC/DC Converter pp. 1-16, 2003 Linear Technology LTC3205 Multidisplay LED Controller pp. 1-16, 2003.

Taiwanese Office Action with English translation issued in Taiwanese Application No. 094124118 dated Feb. 5, 2013.

Japanese Office Action issued in Japanese Patent Application No. 2005-222844, mailed on Feb. 15, 2011.

Chinese Office Action, with English Translation, issued in Chinese Patent Application No. 200510089179.3, dated Jul. 26, 2010.

* cited by examiner

*Primary Examiner* — William Boddie
*Assistant Examiner* — Leonid Shapiro
(74) *Attorney, Agent, or Firm* — McDermott Will & Emery LLP

(57) ABSTRACT

High efficiency drive circuitry for a group of parallel-connected light emitting devices, in which each device is driven in series by a respective source of bias current. The maximum voltage drop among the group of biased light emitting devices is determined and in response, a control voltage to drive all the light emitting device at the lowest effective voltage for the LED group is produced.

94 Claims, 4 Drawing Sheets

CIRCUITRY AND METHODOLOGY FOR DRIVING MULTIPLE LIGHT EMITTING DEVICES

TECHNICAL FIELD

The disclosure relates to circuitry and methodology for driving multiple light emitting devices, such as light emitting diodes, and more particularly to novel circuitry and methodology for regulating a voltage for driving multiple light emitting devices in which the lowest voltage effective for driving all the light emitting devices is generated.

DESCRIPTION OF RELATED ART

White light emitting diodes (LEDs) are widely used for displays of handheld devices, such as PDAs (Personal Digital Assistants) and cellular phones. One of the characteristics of white LEDs is their relatively high forward voltage drops, and in fact, the forward voltage drops of white LEDs are relatively close to battery voltage. Accordingly, the efficiency of driving white LEDs is an important factor to, for example, extend battery life in handheld applications.

Modern techniques for driving white LEDs in handheld applications generally employ one of two types of regulators: charge pumps and inductor-based boost converters. Both types of regulators "step-up" an input voltage (for example, a Li-Ion battery) to a higher voltage required to bias the LEDs. Charge pumps achieve their highest efficiency at an output voltage equal to the input voltage times the amount of "step-up." In a white LED application, if the voltage necessary to drive white LEDs is less than the output voltage at which the highest efficiency is achieved, the additional voltage generated by charge pumps represents an effective efficiency loss. For this reason, the effective efficiency of charge pumps in a white LED application has a strong dependence on input voltage (which varies with 1/Vin). Multi-mode charge pumps improve upon effective efficiency at the expense of additional circuitry and cost. On the other hand, it has been known that inductor-based DC-DC converters can attain a higher level of performance than those achievable with charge pumps including multi-mode charge pumps. Among inductor-based DC-DC converters, buck-boost DC-DC converters are considered to be the most robust in terms of input and output voltage range.

In implementing a white LED display, for example, multiple white LEDs are connected in series or parallel to the output of a regulator. A series connection of multiple LEDs, while providing perfect current matching, requires the regulator to generate a much higher output voltage to drive the white LEDs. This scheme has a disadvantage of requiring more expensive components to withstand the higher voltage. In addition, in the case where inductor-based DC-DC converters are employed, efficiency at higher output to input voltage ratios is reduced. A series connection also has the proverbial "Christmas-tree light problem." A failure in one component affects the whole string. On the other hand, driving multiple LEDs in parallel eliminates the high voltage issue and makes higher efficiency attainable, but requires ballasting to achieve good current matching.

BRIEF SUMMARY OF THE INVENTION

The disclosed subject matter maximizes power efficiency when driving multiple, parallel connected, light emitting devices, such as white light emitting diodes (LEDs), by generating the lowest effective drive voltage.

The disclosed subject matter also provides circuitry including elements configured and selected for maximizing power efficiency when driving multiple, parallel connected light emitting devices.

In one aspect of the disclosure, circuitry for driving multiple parallel-coupled light emitting devices connected to an output node comprises a voltage regulator for controlling the output node, and a control circuit for controlling the regulator to produce substantially a lowest output voltage effective to drive that one of the light emitting devices having the highest forward voltage drop.

In accord with another aspect, the circuit may comprise a voltage regulator for controlling an output node, and bias circuitry for setting a level of current through each light emitting device. The light emitting devices are to be connected in circuit with the output node and bias circuitry. Regulator control circuitry is arranged for controlling the voltage regulator to maintain an operating voltage across the bias circuitry to produce substantially a lowest output voltage effective to drive that one of the light emitting devices having the highest forward voltage drop.

In accord with another aspect of the disclosure, a drive circuit controls a regulator for regulating a power supply voltage to be supplied to a power supply node to which multiple light emitting devices are connected in parallel. Bias circuits are connected in series with the respective light emitting devices. The drive circuit may include a detection circuit configured for receiving signals from the respective bias circuits, and in response, detecting which one of the light emitting devices being biased has the highest forward voltage drop based on the signals. The drive circuit further includes a control circuit coupled to the detection circuit and configured for generating a control signal to control the regulator to produce substantially a lowest voltage effective to drive that one of the light emitting devices having the highest forward voltage drop.

In one embodiment, the signals each indicate a voltage at a corresponding node in each bias circuit. The corresponding node carrying the highest voltage among the nodes indicates which one of the light emitting devices being biased has the highest forward voltage drop. The detection circuit may be configured for detecting the highest voltage, and may comprise an OR-circuit including multiple NPN-transistors, bases of which receive the signals from the bias circuits, respectively, to output a voltage corresponding to the highest voltage.

The control circuit may be configured for comparing the highest voltage detected by the detection circuit with a predetermined reference voltage, and in response, generating the control signal. The control circuit may be a first transconductance amplifier configured for sourcing or sinking a current as the control signal based on the difference between the highest voltage and the reference voltage. The reference voltage is selected so as to control the regulator to produce substantially the lowest output voltage to drive the one of the light emitting devices having the highest forward voltage drop.

The drive circuit can include a second transconductance amplifier configured for sinking a predetermined amount of the current being sourced from the first transconductance amplifier when the output voltage at the output node exceeds a predetermined voltage.

Alternatively, the detection circuit may be configured for detecting the lowest voltage when the corresponding node carrying the lowest voltage among the nodes indicates which one of the light emitting devices being biased has the highest forward voltage drop. In this case, the detection circuit may comprise an OR-circuit including multiple PNP-transistors, bases of which receive the signals from the bias circuits, respectively, to output a voltage corresponding to the lowest voltage.

The control circuit may also be configured for comparing the lowest voltage detected by the detection circuit with a predetermined reference voltage, and in response, generating the control signal. The reference voltage is selected so as to control the regulator to produce substantially the lowest output voltage effective to drive that one of the light emitting devices having the highest forward voltage drop.

The drive circuit may further include a selector, connected between the detection circuit and the control circuit, for comparing the lowest voltage from the detection circuit with a scaled down voltage obtained by scaling down the output voltage at the output node to select the highest voltage. The control circuit may be configured for comparing the highest voltage selected by the selector with the reference voltage.

In another aspect of the disclosure, there is provided detector circuitry comprising input nodes and a detection circuit. The input nodes are arranged for receiving signals from bias circuits connected in series with multiple light emitting devices, respectively, in which the light emitting devices are connected in parallel to a power supply node. The detection circuit is responsive to the signals on the input nodes for detecting which one of the light emitting devices being biased has the highest forward voltage drop.

In yet another aspect of the disclosure, there is provided a method for driving multiple light emitting devices connected in parallel to a power supply node and each connected in series to respective bias circuits for biasing the light emitting devices. A power supply voltage to be applied to the power supply node is regulated. Signals from the respective bias circuits are received, and then based on the signals it is detected as to which one of the light emitting devices being biased has the highest forward voltage drop. In response, a control signal to control the regulating step is generated such that the power supply voltage is caused to attain the lowest voltage effective to drive that one of the light emitting devices having the highest forward voltage drop.

Additional advantages of the present invention will become readily apparent to those skilled in this art from the following detailed description, wherein only the preferred embodiment of the invention is shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description are to be regarded as illustrative in nature, and not as restrictive.

BRIEF DESCRIPTION OF THE DRAWINGS

The present invention is illustrated by way of example, and not by way of limitation, in the figures of the accompanying drawing and in which like reference numerals refer to similar elements and in which.

DETAILED DESCRIPTION

Figure 1:
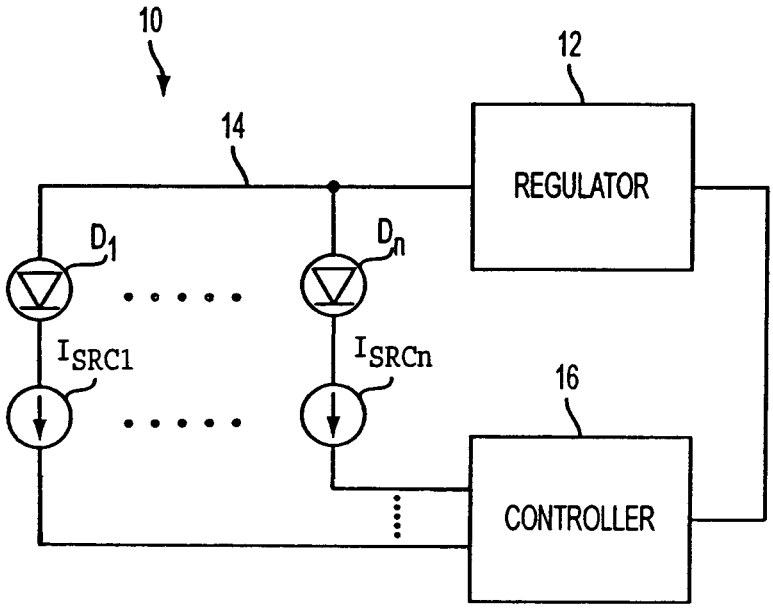
FIG. 1 is a block diagram showing a basic configuration of a driving circuit for driving multiple LEDs.

FIG. 1 shows a basic configuration of a driving circuit for driving multiple LEDs, such as white LEDs. A driving circuit 10 includes a regulator 12 regulating an output voltage to be applied to an output node 14 to which multiple LEDs $D_1$ to $D_n$ are connected in parallel. Each of LEDs $D_1$ to $D_n$ may be connected in series with ballasting such as a current source ($I_{SRC1}$, $I_{SRCn}$) for controlling currents for LEDs $D_1$ to $D_n$.

The forward voltage drop across each of LEDs $D_1$ to $D_n$ may be different from each other due to normal manufacturing variations or unequal current biasing. Regulator 12 thus must generate an output voltage sufficiently high to bias all of LEDs $D_1$ to $D_n$, at a magnitude that is as low as possible for maintaining high power efficiency. A principle employed in this disclosure is to obtain the highest power efficiency by determining which one of LEDs $D_1$ to $D_n$ being biased has the highest forward voltage drop and to control all LEDs $D_1$ to $D_n$ based on that LED with the highest forward voltage drop.

In FIG. 1, a controller 16 determines which one of multiple LEDs $D_1$ to $D_n$ being biased has the highest forward voltage drop. Then, controller 16 generates a control signal for closing a regulation loop on such a particular LED. Controller 16 controls regulator 12 so that the lowest output voltage effective to drive the LED with the highest forward voltage drop is applied to output node 14. This lowest output voltage represents the magnitude of a driving voltage that is as low as possible, yet high enough to drive (bias) effectively all LEDs $D_1$ to $D_n$.

Figure 2:
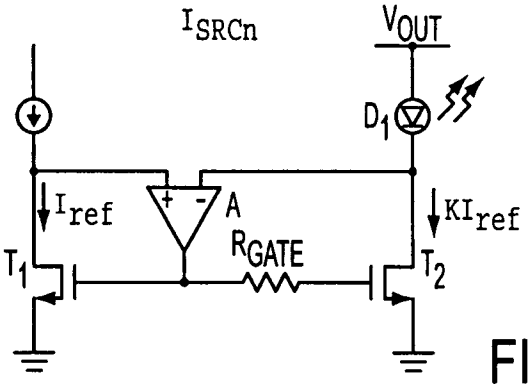
FIG. 2 is a circuit diagram of a low dropout current source for biasing each LED.

The described embodiment implements a conventional, ballasted current source in series with each of LEDs $D_1$ to $D_n$, for providing a drive current to each device. By way of example, FIG. 2 shows an embodiment of current source $I_{SRCn}$ for controlling current to LED $D_1$. Current source $I_{SRCn}$ may include n-type MOS transistors $T_1$ and $T_2$, and an amplifier A which together constitute a current mirror for biasing LED $D_1$.

The drain of transistor $T_1$ is connected to the noninverting input of amplifier A, the drain of transistor $T_2$ is connected to the inverting input of amplifier A, and the output of amplifier A is connected to gates of transistors $T_1$ and $T_2$ which are tied together. A resistor $R_{GATE}$ is included for stability, and does not affect the DC operation of current source $I_{SRCn}$.

A reference current $I_{ref}$ is mirrored with gain K by transistors $T_1$ and $T_2$ to cause a program current $KI_{ref}$ to flow through LED $D_1$. Amplifier A servos the gate voltage of transistor $T_1$ to keep it biased at reference current $I_{ref}$, and causes the drain voltage of transistor $T_1$ to match the drain voltage of transistor $T_2$. This allows transistor $T_2$ to operate in the triode or linear region with a low absolute drain voltage while still matching the drain current of transistor $T_1$. As persons skilled in the art understand, the factor K is a function of the geometries of transistors $T_1$, $T_2$.

This current source $I_{SRCn}$ is specifically designed for low dropout operation, because it enables transistor $T_2$ to operate with a low absolute drain voltage. By combining this current source with the scheme in this disclosure, highly effective driving voltage regulation is achievable by maintaining the voltage across the current source to be as low as possible, but large enough to control its LED to emit light at a rated level.

In this embodiment, MOS transistors are used to form a specific current mirror circuit, as depicted. However, it is apparent to persons skilled in this art that current mirrors with different configurations, for example, by employing bipolar transistors, or using different circuit topologies, could be implemented.

Figure 3:
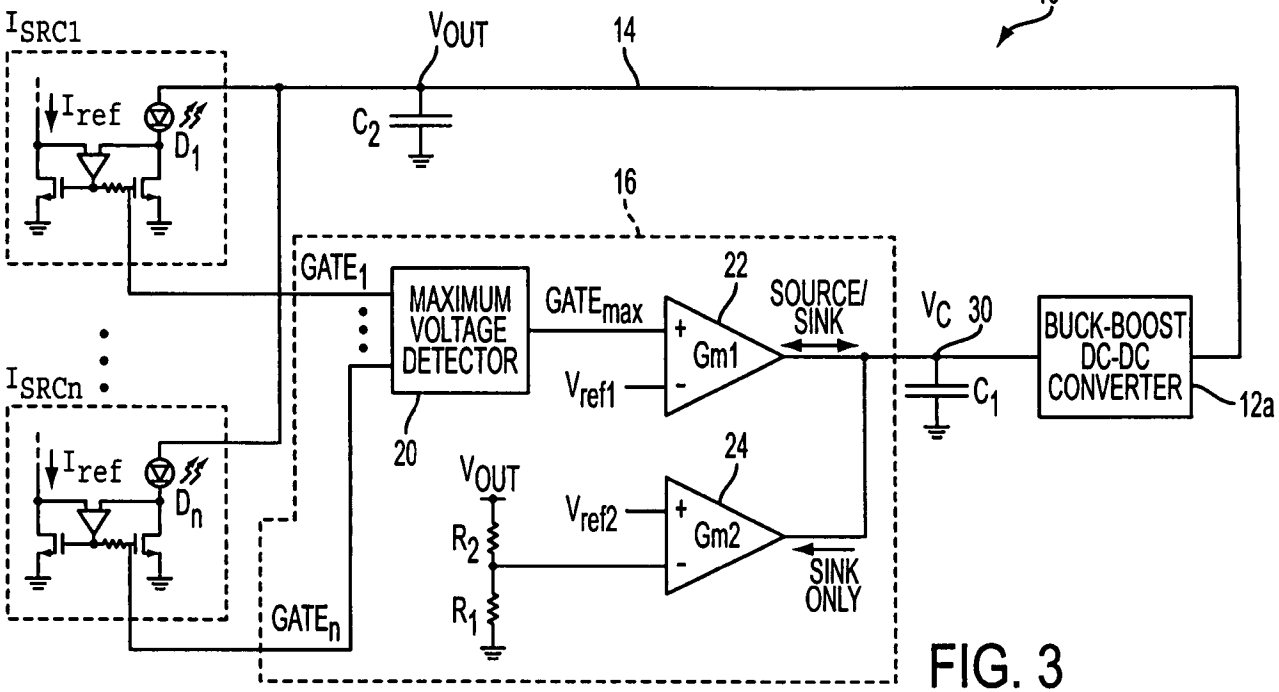
FIG. 3 is a detailed circuit diagram of the driving circuit shown in FIG. 1.

FIG. 3 is a more detailed diagram of an exemplary embodiment of driving circuit 10 shown in FIG. 1. Referring to FIG. 3, control circuit 16 is configured to receive signals from respective current sources $I_{SRC1}$ to $I_{SRCn}$, each having the same configuration as that of current source $I_{SRCn}$ shown in FIG. 2. As described above, control circuit 16 first determines which one of LEDs D1 to Dn has the highest forward voltage drop. For such a determination, since the drain and gate voltages are linear and reciprocal functions, respectively, of the forward voltage drops of LEDs, either the drain voltages or the gate voltages of these transistors can be monitored. In the embodiment depicted, control circuit 16 receives the gate voltages $GATE_1$ to $GATE_n$ of transistors $T_2$ in respective current sources $I_{SRC1}$ through $I_{SRCn}$, to detect which one of the LEDs has the highest forward voltage drop. Since each of current sources $I_{SRC1}$ to $I_{SRCn}$ is biased from the same reference current $I_{ref}$, the highest gate voltage among gate voltages $GATE_1$ to $GATE_n$ corresponds to the lowest counterpart drain voltage of transistor $T_2$ in any of current sources $I_{SRC1}$ to $I_{SRCn}$. This, in turn, identifies which one of the LEDs has the highest forward voltage drop. For example, a typical drain voltage is 50 to 100 mV.

It will be appreciated that the detection circuit implemented to determine which one of the LEDs has the highest forward voltage drop is not limited to the above configuration. Other configurations are possible, depending, for example, on topology of current source employed.

To make the maximum gate voltage determination, controller 16 may include a maximum voltage detector (or selector) 20 and transconductance amplifiers 22 and 24. Maximum voltage detector 20 is configured for receiving the gate voltages $GATE_1$ to $GATE_n$ from respective current sources $I_{SRC1}$ to $I_{SRCn}$, and detecting the highest of gate voltages $GATE_1$ to $GATE_n$. Maximum voltage detector 20 outputs a voltage $GATE_{max}$ corresponding to the highest gate voltage detected. Voltage $GATE_{max}$ from maximum voltage detector 20 is supplied to the noninverting input of transconductance amplifier 22, in which the inverting input receives a reference voltage $V_{ref1}$. The output of transconductance amplifier 22 is connected to a capacitor $C_1$ at a node 30. Capacitor $C_1$ connected between node 30 and ground is a compensation capacitor for the regulation loop and provides a control voltage $V_c$ to a buck-boost DC-DC converter 12*a* that carries out regulation of voltage $V_{OUT}$ for supply to the LEDs $D_1$ to $D_n$.

Reference voltage $V_{ref1}$ is selected so as to control the regulation loop to produce substantially the lowest output voltage effective to drive the one of LEDs $D_1$ to $D_n$ having the highest voltage drop. In the case where current sources $I_{SRC1}$ to $I_{SRCn}$ are employed, reference voltage $V_{ref1}$ can be determined based on internal characteristics of amplifier A in each of current sources $I_{SRC1}$ to $I_{SRCn}$. As described above, voltage $GATE_{max}$ corresponds to the lowest drain voltage from among transistors $T_1$ and $T_2$ in any of current source $I_{SRC1}$ to $I_{SRCn}$ In other words, the higher the gate voltage, the lower the drain voltage. Therefore, the highest possible voltage can be selected as reference voltage $V_{ref1}$, on condition that amplifier A is able to operate in its high-gain common mode range, i.e., the active region, when voltage $GATE_{max}$ is equal to reference voltage $V_{ref1}$. Otherwise, each of current sources $I_{SRC1}$ to $I_{SRCn}$ cannot enable transistor $T_2$ to operate with a low absolute drain voltage while matching the drain current of transistor $T_1$. It is desirable to set reference voltage $V_{ref1}$ so that amplifier A can operate in a higher region within its output common mode range.

The regulation loop servos output voltage $V_{OUT}$ at node 14 to a voltage such that voltage $GATE_{max}$ will be equal to reference voltage $V_{ref1}$. When the voltage $GATE_{max}$ is higher than reference voltage $V_{ref1}$, transconductance amplifier 22 sources current to node 30. On the other hand, when voltage $GATE_{max}$ is lower than reference voltage $V_{ref1}$, transconductance amplifier 22 sinks current from node 30. Control voltage $V_c$ for buck-boost DC-DC circuit 12*a* accordingly varies depending on the sourcing and sinking currents of transconductance amplifier 22.

Drive circuit 10 may further include a transconductance amplifier 24, provided as an active clamp to prevent output voltage runaway that may occur if any of LEDs $D_1$ to $D_n$ becomes open-circuited. Transconductance amplifier 24 has an inverting input coupled to a junction of resistors $R_1$ and $R_2$ and a noninverting input coupled to a reference voltage $V_{ref2}$. Transconductance amplifier 24 may be designed so that when voltage $V_{OUT}$ rises to $[V_{ref2}(R_2+R_1)/R_1]$, the amplifier starts sinking a current equivalent in magnitude to the maximum current that amplifier 22 would be sourcing with one or more LEDs open-circuited. The level of $[V_{ref2}(R_2+R_1)/R_1]$ is placed comfortably away from the anticipated LED forward voltage so that amplifier 24 does not interfere in normal operation. Reference voltage $V_{ref2}$, and resistors $R_1$ and $R_2$ can be determined so as to comport with conditions adopted for drive circuit 10.

Buck-boost DC-DC converter 12*a* is supplied with control voltage $V_c$ controlled by transconductance amplifier 22 so as to produce the lowest drive voltage for that particular LED having the highest forward voltage drop. In general, a buck-boost DC-DC converter operates in buck mode, boost mode or buck-boost mode. In buck mode, the converter regulates an output voltage that is less than the input voltage. In the boost mode, the regulator regulates an output voltage that is greater than the input voltage. In buck and boost modes, fewer than all of the internal switches are switched ON and OFF to regulate the output voltage, to conserve power. In buck-boost mode, all of the switches switch ON and OFF to regulate the output voltage to a value that is greater than, less than, or equal to the input voltage. A buck-boost DC-DC converter is disclosed in U.S. Pat. No. 6,166,527 in detail, which is hereby incorporated by reference. Of course, other types of inductor-based DC-DC converters as well as charge pumps can be adopted to driving circuit 10, instead of a buck-boost DC-DC converter.

Further, drive circuit 10 may include a capacitor $C_2$ connected between node 14 and ground, which serves as an output bypass capacitor holding a DC output voltage. When buck-boost DC-DC converter 12*a* does not deliver current, capacitor $C_2$ delivers current to the load, i.e., LEDs $D_1$ to $D_n$.

Figure 4:
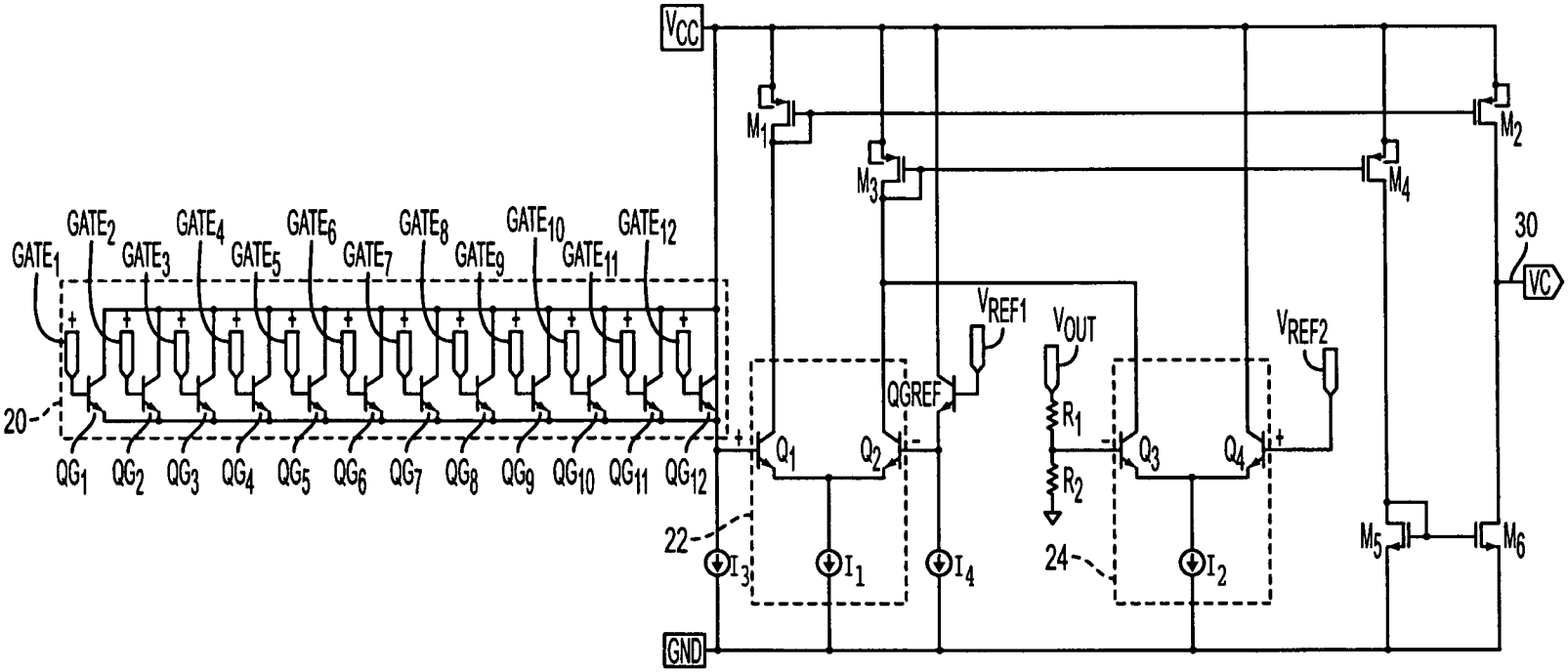
FIG. 4 is a detailed circuit diagram showing a maximum voltage detector and transconductance amplifiers shown in FIG. 3.

FIG. 4 shows an example of a circuit configuration of maximum voltage detector 20 and transconductance amplifiers 22 and 24, which are provided between power supply voltages Vcc and GND.

Maximum voltage detector 20 comprises an OR-circuit including a plurality of NPN-transistors $QG_1$ to $QG_{12}$. In FIG. 4, maximum voltage detector 20 is configured on the assumption that there are 12 current sources. All bases of transistors $QG_1$ to $QG_{12}$ are tied to potentially different voltages, respectively, i.e., gate voltages $GATE_1$ to $GATE_n$ from respective current sources $I_{SRC1}$ to $I_{SRCn}$. All emitters of transistors $QG_1$ to $QG_{12}$ are tied together. In maximum voltage detector 20, that base voltage of that one of transistors $QG_1$ to $QG_{12}$ which is the highest will be the one determining the voltage at the connected emitters ($GATE_{max}$ shown in FIG. 3). For example, when the base of transistor $QG_1$ is of voltage 100 mV higher in magnitude than the other bases, then transistor $QG_1$ will conduct current $I_3$, and the others are essentially turned off. Therefore, the DC level-shifted highest gate voltage, $GATE_{max}$, can be obtained.

Transconductance amplifier 22 is implemented by NPN differential pair transistors $Q_1$ and $Q_2$ with a tail current $I_1$ and transconductance amplifier 24 is similarly implemented by NPN differential pair transistors $Q_3$ and $Q_4$ with a tail current $I_2$.

The DC level-shifted $GATE_{max}$ voltage produced by maximum voltage detector 20 in FIG. 4 is coupled to the non-inverting input of transconductance amplifier 22. In FIG. 4, the $GATE_{max}$ voltage is level-shifted by the one of transistors $QG_1$ to $QG_{12}$ receiving the highest gate voltage, i.e., $GATE_{max}=V_{IN}-V_{BE}$. Thus, transistor QGREF, being biased with current source $I_4$, level-shifts the reference voltage $V_{ref1}$ to $(V_{ref1}-V_{BE})$ so that the $GATE_{max}$ voltage and reference voltage $V_{ref1}$ are appropriately compared by transconductance amplifier 22.

Pairs of transistors $M_1$-$M_2$, $M_3$-$M_4$ and $M_5$-$M_6$ constitute current mirrors for performing appropriate summing of currents at node 30, for producing control voltage $V_c$ to buck-boost DC-DC converter 12*a*. The collector current of transistor $Q_1$ is mirrored by transistors $M_1$ and $M_2$ with unity gain, which represents a sourcing current to node 30. Transistor $Q_2$ collector current is mirrored by transistors $M_3$ and $M_4$ with unity gain, and mirrored again by transistors $M_5$ and $M_6$ with unity gain, which represents a sinking current from node 30. A point of balance is obtained when the current $M_2$ sourcing to node 30 is equal to the current $M_6$ sinking from node 30. In such a case, the collector currents of transistors $Q_1$ and $Q_2$ are equal, and thus, the $GATE_{max}$ voltage and reference voltage $V_{ref1}$ are equal. In this condition, the lowest voltage to drive LEDs $D_1$ to $D_n$ is applied to output node 14 by buck-boost DC-DC converter 12*a*.

As described above, drive circuit 10 drives LEDs $D_1$ to $D_n$ based on that particular LED having the highest forward voltage drop. Drive circuit 10 controls the output voltage to be the lowest voltage effective to drive such a particular LED having the highest forward voltage drop. Although the voltage is the lowest for that particular LED, the voltage is high enough to drive all the parallel connected LEDs. Therefore, power efficiency for driving multiple LEDs is improved because the lowest effective drive voltage driving all the LEDs is applied to output node 14. In addition, by employing a buck-boost DC-DC converter and a low dropout current source as shown in FIG. 2, power efficiency can be maximized.

Alternative Embodiment

Figure 5:
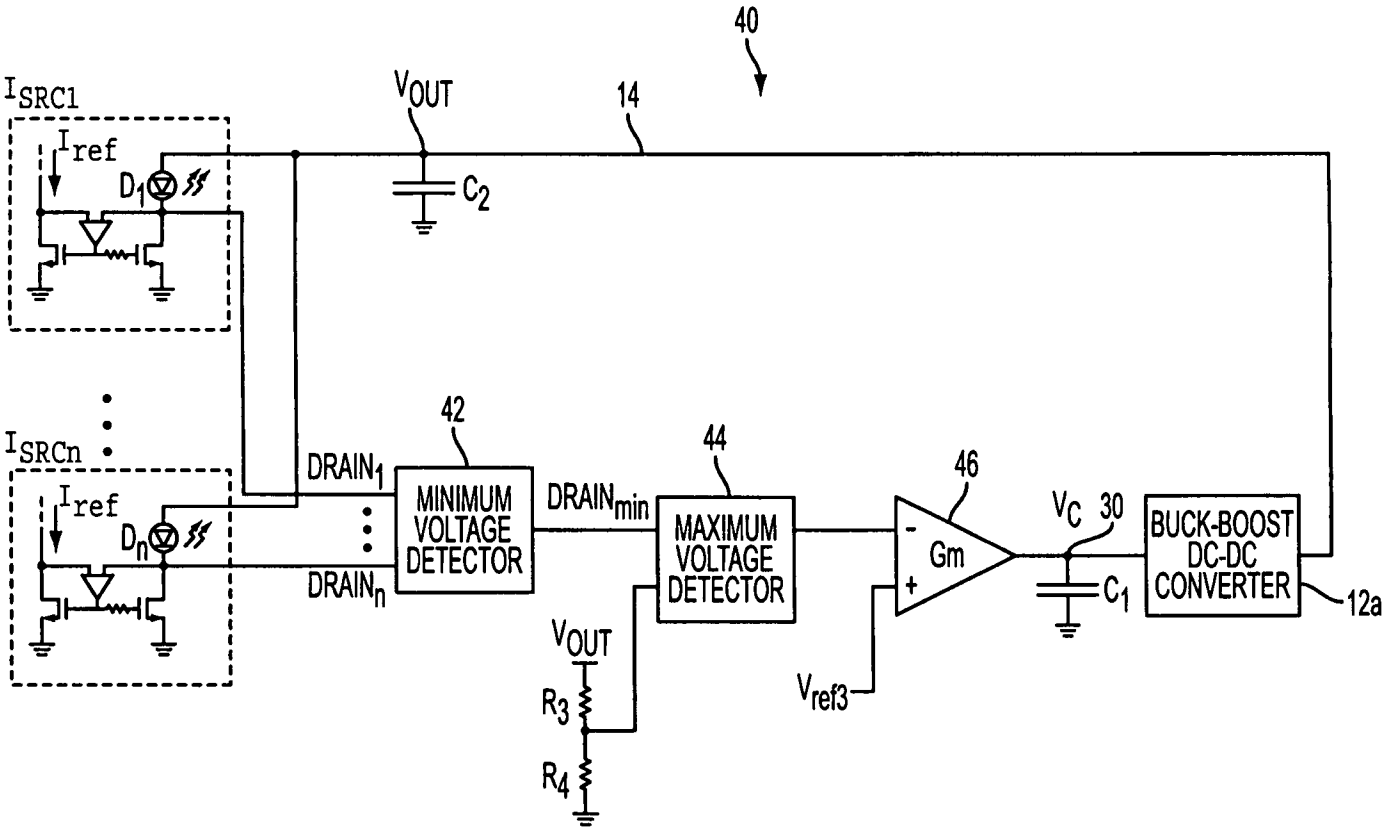
FIG. 5 is a circuit diagram showing an alternative embodiment of the driving circuit.

FIG. 5 shows an alternative embodiment of driving circuit 10 utilizing the drain voltages of transistors $T_1$ and $T_2$ within current sources $I_{SRC1}$ to $I_{SRCn}$, rather than the gate voltages for the same purpose. As explained, the lowest drain voltage among current sources $I_{SRC1}$ to $I_{SRCn}$ identifies which one of LEDs $D_1$ to $D_n$ being biased has the highest forward voltage drop.

Referring to FIG. 5, driving circuit 40 includes a minimum voltage detector (or selector) 42 to detect the lowest of drain voltages DRAIN1 to DRAINn among respective transistors $T_1$ and $T_2$ of current source $I_{SRCn}$ in FIG. 2. Accordingly, a voltage $DRAIN_{min}$ corresponding to the lowest drain voltage is output from minimum voltage detector 42. Minimum voltage detector 42 can be implemented by using an OR-circuit including multiple PNP-transistors, which is of a configuration complementary to that of maximum voltage detector 20 shown in FIG. 4.

Driving circuit 40 further includes a maximum voltage detector 44 which receives the voltage $DRAIN_{min}$ from the minimum voltage detector 42 and a scaled down voltage obtained by dividing output voltage $V_{OUT}$ at resistors $R_3$ and $R_4$ forming a voltage divider. Maximum voltage detector 44 detects or selects the higher of the voltage $DRAIN_{min}$ and the scaled down voltage. As explained in more detail below, this maximum voltage detector 44 acts as an active clamp. The output of maximum voltage detector 44 is provided to an inverting input of a transconductance amplifier 46 whose noninverting input is coupled to a reference voltage $V_{ref3}$. Similar to amplifier 22 in FIGS. 3 and 4, transconductance amplifier 46 provides current to node 30 according to the difference between reference voltage $V_{ref3}$ and the output from maximum voltage detector 44, to control buck-boost DC-DC converter 12*a*.

Reference voltage $V_{ref3}$ is selected so as to control the regulation loop to produce substantially the lowest output voltage to drive effectively that LED having the highest forward voltage drop. In the case where current sources $I_{SRC1}$ to $I_{SRCn}$ are employed, reference voltage $V_{ref3}$ can be determined based on internal characteristics of amplifier A in each of current sources $I_{SRC1}$ to $I_{SRCn}$. The lower the drain voltage, the lower the driving voltage necessary to drive the LED having the highest forward voltage drop. Therefore, the lowest possible voltage can be selected as reference voltage $V_{ref3}$, on condition that amplifier A is able to operate in its high-gain common mode range, i.e., an active region, when an output voltage from maximum voltage detector 44 (voltage $DRAIN_{min}$ or the scaled down voltage) becomes equal to reference voltage $V_{ref}$. Otherwise, current sources $I_{SRC1}$ to $I_{SRCn}$ cannot enable transistors $T_2$ to operate with a low absolute drain voltage while matching the drain current of transistor $T_1$. It is desirable to set reference voltage $V_{ref3}$ so that amplifier A can operate in a lower range within its input common mode range.

Maximum voltage detector 44 prevents an excessive voltage from being applied to output node 14. When one of LEDs $D_1$ to $D_n$ is open-circuited, the corresponding one of drain voltages $DRAIN_1$ to $DRAIN_n$ collapses to ground, and in response, voltage $DRAIN_{min}$ from minimum voltage detector 42 will be at ground voltage. If ground voltage is input to transconductance amplifier 46, the amplifier sources more current to node 30. This results in an increased output from buck-boost DC-DC converter 12*a*. However, even if one of voltages $DRAIN_1$ to $DRAIN_n$ collapses to ground, the maximum voltage detector 44 selects the scaled down voltage rather than voltage $DRAIN_{min}$ having the ground voltage. Accordingly, the scaled down voltage is input to transconductance amplifier 46, so that the regulation loop is properly maintained.

As described above, driving circuit 40 uses two different regulation loops. The first regulation loop is controlled based on voltage $DRAIN_{min}$ from minimum voltage detector 42. The second regulation loop is controlled based on the scaled down voltage input to maximum voltage detector 44.

It will be appreciated that values of resistor $R_3$ and $R_4$ forming the voltage divider can be selected in accordance with reference voltage $V_{ref3}$ in order to properly regulate the regulation loop.

Further, in the above embodiment, the driving circuit is described in the context of driving multiple LEDs such as white LEDs. However the disclosed subject is not limited to white LEDs, but can be applied to drive any kind of light emitting devices including but not limited to red and blue LEDs.

In this disclosure there are shown and described only preferred embodiments of the invention and but a few examples of its versatility. It is to be understood that the invention is capable of use in various other combinations and environments and is capable of changes or modifications within the scope of the inventive concept as expressed herein.

What is claimed is:

1. Circuitry having an input voltage range for driving multiple parallel-coupled light emitting devices connected to an output node in which each light emitting device is biased by a respective bias circuit, the circuitry comprising:

a regulator configured for regulating an output voltage to be applied to the output node;

a detection circuit configured for receiving signals from the respective bias circuits, and in response, detecting which one of the light emitting devices being biased has the highest forward voltage drop; and a control circuit coupled to the detection circuit and configured for generating a control signal to control the regulator to produce substantially a lowest output voltage effective to drive that one of the light emitting devices having the highest forward voltage drop throughout substantially the input voltage range.

2. The circuitry according to claim 1, wherein the signals each indicate a voltage at a corresponding node in each bias circuit, and the node carrying the highest voltage among the corresponding nodes indicates which one of the light emitting devices being biased has the highest forward voltage drop, and the detection circuit is configured for detecting the highest voltage.

3. The circuitry according to claim 2, wherein the detection circuit comprises an OR-circuit including multiple NPN-transistors, bases of which receive the signals from the bias circuits, respectively, to output a voltage corresponding to the highest voltage.

4. The circuitry according to claim 2, wherein the control circuit is configured for comparing the highest voltage detected by the detection circuit with a predetermined reference voltage, and in response, generating the control signal, and the reference voltage is selected so as to control the regulator to produce substantially the lowest output voltage to drive that one of the light emitting devices having the highest forward voltage drop.

5. The circuitry according to claim 4, wherein the control circuit comprises a first transconductance amplifier configured for sourcing or sinking a current as the control signal based on the difference between the highest voltage and the reference voltage.

6. The circuitry according to claim 5, further comprising a second transconductance amplifier configured for sinking a predetermined amount of the current being sourced from the first transconductance amplifier when the output voltage at the output node exceeds a predetermined voltage.

7. The circuitry according to claim 4, wherein the bias circuits each include MOS transistors and an amplifier for constituting a current mirror, in which a reference current is mirrored with a gain of K by the transistors to cause a current to flow through a light emitting device connected to the output node, drains of the transistors are connected to respective inputs of the amplifier, an output of the amplifier is connected to gates of the transistors, and the amplifier maintains drain and gate voltages of one of the transistors to be equal to those of another, and the reference voltage is set to be the highest possible voltage to enable the amplifier in each bias circuit to operate in its high-gain common mode range.

8. The circuitry according to claim 7, wherein the corresponding nodes are coupled for obtaining the gate voltages of the transistors.

9. The circuitry according to claim 1, wherein the signals each indicate a voltage at a corresponding node in each bias circuit, and that node carrying the lowest voltage among the corresponding nodes indicates which one of the light emitting devices being biased has the highest forward voltage drop, and the detection circuit is configured for detecting the lowest voltage.

10. The circuitry according to claim 9, wherein the detection circuit comprises an OR-circuit including multiple PNP-transistors, bases of which receive the signals from the bias circuits, respectively, to output a voltage corresponding to the lowest voltage.

11. The circuitry according to claim 9, wherein the control circuit is configured for comparing the lowest voltage detected by the detection circuit with a predetermined reference voltage, and in response, generating the control signal, and the reference voltage is selected so as to control the regulator to produce substantially the lowest output voltage to drive that one of the light emitting devices having the highest forward voltage drop.

12. The circuitry according to claim 11, further comprising a selector, connected between the detection circuit and the control circuit, for comparing the lowest voltage from the detection circuit with a scaled down voltage obtained by scaling down the output voltage at the output node to select the highest voltage, wherein the control circuit is configured for comparing the highest voltage selected by the selector with the reference voltage.

13. The circuitry according to claim 11, wherein the bias circuits each include MOS transistors and an amplifier for constituting a current mirror, in which a reference current is mirrored with a gain of K by the transistors to cause a current to flow through a light emitting device connected to the output node, drains of the transistors are connected to respective inputs of the amplifier, an output of the amplifier is connected to gates of the transistors, and the amplifier maintains drain and gate voltages of one of the transistors to be equal to those of another, and the reference voltage is set to be the lowest possible voltage to enable the amplifier in each bias circuit to operate in its high-gain common mode range.

14. The circuitry according to claim 13, wherein the corresponding nodes are coupled for obtaining the drain voltages of the transistors.

15. The circuitry according to claim 1, wherein the light emitting devices are light emitting diodes.

16. The circuitry according to claim 15, wherein the light emitting diodes are white light emitting diodes.

17. The circuitry according to claim 1, wherein the regulator is an inductor-based DC-DC converter.

18. The circuitry according to claim 17, wherein the inductor-based DC-DC converter is a buck-boost DC-DC converter.

19. The circuitry according to claim 1, further comprising a clamp circuit for preventing an excessive voltage from being applied to the output node.

20. Circuitry having an input voltage range for controlling a regulator for regulating an output voltage to be supplied to an output node to which multiple light emitting devices are connected in parallel, in which each light emitting device is biased by a respective bias circuit, the circuitry comprising:

a detection circuit configured for receiving signals from the respective bias circuits, and in response, detecting which one of the light emitting devices being biased has the highest forward voltage drop based on the signals; and a control circuit coupled to the detection circuit and configured for generating a control signal to control the regulator to produce substantially a lowest voltage effective to drive that one of the light emitting devices having the highest forward voltage drop throughout substantially the input voltage range.

21. The circuitry according to claim 20, wherein the signals each indicate a voltage at a corresponding node in each bias circuit, and the node carrying the highest voltage among the corresponding nodes indicates which one of the light emitting devices being biased has the highest forward voltage drop, and the detection circuit is configured for detecting the highest voltage.

22. The circuitry according to claim 21, wherein the detection circuit comprises an OR-circuit including multiple NPN-transistors, bases of which receive the signals from the bias circuits, respectively, to output a voltage corresponding to the highest voltage.

23. The circuitry according to claim 21, wherein the control circuit is configured for comparing the highest voltage detected by the detection circuit with a predetermined reference voltage, and in response, generating the control signal, and the reference voltage is selected so as to control the regulator to produce substantially the lowest output voltage to drive that one of the light emitting devices having the highest forward voltage drop.

24. The circuitry according to claim 23, wherein the control circuit comprises a first transconductance amplifier configured for sourcing or sinking a current as the control signal based on the difference between the highest voltage and the reference voltage.

25. The circuitry according to claim 24, further comprising a second transconductance amplifier configured for sinking a predetermined amount of the current being sourced from the first transconductance amplifier when the output voltage at the output node exceeds a predetermined voltage.

26. The circuitry according to claim 23, wherein the bias circuits each include MOS transistors and an amplifier for constituting a current mirror, in which a reference current is mirrored with a gain of K by the transistors to cause a current to flow through a light emitting device connected to the output node, drains of the transistors are connected to respective inputs of the amplifier, an output of the amplifier is connected to gates of the transistors, and the amplifier maintains drain and gate voltages of one of the transistors to be equal to those of another, and the reference voltage is set to be the highest possible voltage to enable the amplifier in each bias circuit to operate in its high-gain common mode range.

27. The circuitry according to claim 26, wherein the corresponding nodes are coupled for obtaining the gate voltages of the transistors.

28. The circuitry according to claim 20, wherein the signals each indicate a voltage at a corresponding node in each bias circuit, and the node carrying the lowest voltage among the corresponding nodes indicates which one of the light emitting devices being biased has the highest forward voltage drop, and the detection circuit is configured for detecting the lowest voltage.

29. The circuitry according to claim 28, wherein the detection circuit comprises an OR-circuit including multiple PNP-transistors, bases of which receive the signals from the bias circuits, respectively, to output a voltage corresponding to the lowest voltage.

30. The circuitry according to claim 28, wherein the control circuit is configured for comparing the lowest voltage detected by the detection circuit with a predetermined reference voltage, and in response, generating the control signal, and the reference voltage is selected so as to control the regulator to produce substantially the lowest output voltage to drive that one of the light emitting devices having the highest forward voltage drop.

31. The circuitry according to claim 30, further comprising a selector, connected between the detection circuit and the control circuit, for comparing the lowest voltage from the detection circuit with a scaled down voltage obtained by scaling down the output voltage at the output node to select the highest voltage, wherein the control circuit is configured for comparing the highest voltage selected by the selector with the reference voltage.

32. The circuitry according to claim 30, wherein the bias circuits each include MOS transistors and an amplifier for constituting a current mirror, in which a reference current is mirrored with a gain of K by the transistors to cause a current to flow through a light emitting device connected to the output node, drains of the transistors are connected to respective inputs of the amplifier, an output of the amplifier is connected to gates of the transistors, and the amplifier maintains drain and gate voltages of one of the transistors to be equal to those of another, and the reference voltage is set to be the lowest possible voltage to enable the amplifier in each bias circuit to operate in its high-gain common mode range.

33. The circuitry according to claim 32, wherein the corresponding nodes are coupled for obtaining the drain voltages of the transistors.

34. The circuitry according to claim 20, wherein the light emitting devices are light emitting diodes.

35. The circuitry according to claim 34, wherein the light emitting diodes are white light emitting diodes.

36. The circuitry according to claim 20, wherein the regulator is an inductor-based DC-DC converter.

37. The circuitry according to claim 36, wherein the inductor-based DC-DC converter is a buck-boost DC-DC converter.

38. The circuitry according to claim 20, further comprising a clamp circuit for preventing an excessive voltage from being applied to the output node.

39. Circuitry comprising:

input nodes for receiving signals from bias circuits connected in series with multiple light emitting devices, respectively, the light emitting devices connected in parallel to a power supply node;

a detection circuit, responsive to the signals on the input nodes, for detecting which one of the light emitting devices being biased has the highest forward voltage drop; and control circuitry configured, responsive to the detection of the detection circuit, for selectively increasing and decreasing an output voltage to be applied to the power supply node so as to maintain the output voltage to be a lowest output voltage effective to drive that one of the light emitting devices.

40. The circuitry according to claim 39, wherein the signals each indicate a voltage at a corresponding node in each bias circuit, and the node carrying the highest voltage among the corresponding nodes indicates which one of the light emitting devices being biased has the highest forward voltage drop, and the detection circuit is configured for detecting the highest voltage.

41. The circuitry according to claim 40, wherein the detection circuit comprises an OR-circuit including multiple NPN-transistors, bases of which receive the signals from the input nodes, respectively, to output a voltage corresponding to the highest voltage.

42. The circuitry according to claim 40, wherein the bias circuits each include MOS transistors and an amplifier for constituting a current mirror, in which a reference current is mirrored with a gain of K by the transistors to cause a current to flow through a light emitting device connected to the power supply node, drains of the transistors are connected to respective inputs of the amplifier, an output of the amplifier is connected to gates of the transistors, and the amplifier maintains drain and gate voltages of one of the transistors to be equal to those of another, and the corresponding nodes are coupled for obtaining the gate voltages of the transistors.

43. The circuitry according to claim 39, wherein the signals each indicate a voltage at a corresponding node in each bias circuit, and the node carrying the lowest voltage among the corresponding nodes indicates which one of the light emitting devices being biased has the highest forward voltage drop, and the detection circuit is configured for detecting the lowest voltage.

44. The circuitry according to claim 43, wherein the detection circuit comprises an OR-circuit including multiple PNP-transistors, bases of which receive the signals from the input nodes, respectively, to output a voltage corresponding to the lowest voltage.

45. The circuitry according to claim 43, wherein the bias circuits each include MOS transistors and an amplifier for constituting a current mirror, in which a reference current is mirrored with a gain of K by the transistors to cause a current to flow through a light emitting device connected to the power supply node, drains of the transistors are connected to respective inputs of the amplifier, an output of the amplifier is connected to gates of the transistors, and the amplifier maintains drain and gate voltages of one of the transistors to be equal to those of another, and the corresponding nodes are coupled for obtaining the drain voltages of the transistors.

46. The circuitry according to claim 39, wherein the light emitting devices are light emitting diodes.

47. The circuitry according to claim 46, wherein the light emitting diodes are white light emitting diodes.

48. A method for controlling circuitry having an input voltage range to drive multiple light emitting devices connected in parallel to an output node and each connected in series to respective bias circuits for biasing the light emitting devices, the method comprising the steps of:

regulating an output voltage to be applied to the output node;

receiving signals from the respective bias circuits, detecting which one of the light emitting devices being biased has the highest forward voltage drop based on the signals; and generating a control signal to control the regulating step such that the output voltage is caused to attain the lowest voltage to drive that one of the light emitting devices having the highest forward voltage drop throughout substantially the input voltage range.

49. The method according to claim 48, wherein the signals each indicate a voltage at a corresponding node in each bias circuit, and the node carrying the highest voltage among the corresponding nodes indicates which one of the light emitting devices being biased has the highest forward voltage drop, and the detecting step detects the highest voltage.

50. The method according to claim 49, further comprising the step of comparing the highest voltage detected in the detecting step with a predetermined reference voltage, the reference voltage being selected so as to produce substantially the lowest output voltage to drive that one of the light emitting devices having the highest forward voltage drop, wherein the generating step generates the control signal based on the difference between the highest voltage and the reference voltage.

51. The method according to claim 50, wherein the generating step includes sourcing or sinking a current as the control signal based on the difference between the highest voltage and the reference voltage.

52. The method according to claim 51, further comprising the step of determining whether the output voltage at the output node exceeds a predetermined voltage, and sinking a predetermined amount of the current being sourced by the generating step when the output voltage exceeds the predetermined voltage.

53. The method according to claim 50, wherein the bias circuits each include MOS transistors and an amplifier for constituting a current mirror, in which a reference current is mirrored with a gain of K by the transistors to cause a current to flow through a light emitting device connected to the output node, drains of the transistors are connected to respective inputs of the amplifier, an output of the amplifier is connected to gates of the transistors, and the amplifier maintains drain and gate voltages of one of the transistors to be equal to those of another, the method further comprising the step of setting as the reference voltage the highest possible voltage to enable the amplifier in each bias circuit to operate in its high-gain common mode range.

54. The method according to claim 53, wherein the receiving step obtains the gate voltages of the transistors from each of the bias circuit.

55. The method according to claim 48, wherein the signals each indicate a voltage at a corresponding node in each bias circuit, and the node carrying the lowest voltage among the corresponding nodes indicates which one of the light emitting devices being biased has the highest forward voltage drop, and the detecting step detects the lowest voltage.

56. The method according to claim 55, further comprising the step of comparing the lowest voltage detected in the detecting step with a reference voltage, the reference voltage being selected so as to produce substantially the lowest output voltage to drive that one of the light emitting devices having the highest forward voltage drop, wherein the generating step generates the control signal based on the difference between the reference voltage and the lowest voltage.

57. The method according to claim 56, further comprising the step of scaling down the output voltage at the output node to obtain a scaled down voltage; and comparing the lowest voltage detected in the detecting step with the scaled down voltage to select the higher one, wherein the controlling step generates the control signal by comparing the higher one with the reference voltage.

58. The method according to claim 56, wherein the bias circuits each include MOS transistors and an amplifier for constituting a current mirror, in which a reference current is mirrored with a gain of K by the transistors to cause a current to flow through a light emitting device connected to the output node, drains of the transistors are connected to respective inputs of the amplifier, an output of the amplifier is connected to gates of the transistors, and the amplifier maintains drain and gate voltages of one of the transistors to be equal to those of another, and the method further comprising the step of setting as the reference voltage the lowest possible voltage to enable the amplifier in each bias circuit to operate in its high-gain common mode range.

59. The method according to claim 58, wherein the receiving step obtains the drain voltages of the transistors from each of the bias circuits.

60. Circuitry having an input voltage range for driving multiple parallel-coupled light emitting devices connected to an output node, comprising:

a voltage regulator for controlling the output node; and a control circuit for controlling the regulator to produce substantially a lowest output voltage effective to drive one of the light emitting devices having the highest forward voltage drop throughout substantially the input voltage range.

61. Circuitry having an input voltage range for driving multiple parallel-coupled light emitting devices connected to an output node, comprising:

a voltage regulator for controlling an output node;

bias circuitry for setting a level of current through each light emitting device;

the light emitting devices to be connected in circuit with the output node and bias circuitry; and regulator control circuitry for controlling the voltage regulator to maintain an operating voltage across the bias circuitry to produce substantially a lowest output voltage effective to drive one of the light emitting devices having the highest forward voltage drop throughout substantially the input voltage range.

62. Circuitry for driving multiple parallel-coupled light emitting devices connected to an output node, comprising:

a control circuit configured for controlling an output voltage to the output node to be substantially a lowest output voltage effective to drive one of the light emitting devices having the highest forward voltage drop; and a voltage regulator configured, responsive to the control of the control circuit, for selectively increasing and decreasing the output voltage to be applied to the output node.

63. Circuitry according to claim 62, further comprising:

bias circuits configured for biasing the light emitting devices, respectively; and a detection circuit configured for receiving signals from the respective bias circuits, and in response, detecting which one of the light emitting devices being biased has the highest forward voltage drop, wherein the control circuit is coupled to the detection circuit and responsive to the detection by the detection circuit, generating a control signal to control the regulator.

64. The circuitry according to claim 63, wherein the signals each indicate a voltage at a corresponding node in each bias circuit, and the node carrying the highest voltage among the corresponding nodes indicates which one of the light emitting devices being biased has the highest forward voltage drop, and the detection circuit is configured for detecting the highest voltage.

65. The circuitry according to claim 63, wherein the signals each indicate a voltage at a corresponding node in each bias circuit, and that node carrying the lowest voltage among the corresponding nodes indicates which one of the light emitting devices being biased has the highest forward voltage drop, and the detection circuit is configured for detecting the lowest voltage.

66. The circuitry according to claim 62, wherein the regulator is an inductor-based DC-DC converter.

67. The circuitry according to claim 62, wherein the inductor-based DC-DC converter is a buck-boost DC-DC converter.

68. Circuitry for driving multiple parallel-coupled light emitting devices connected to an output node, comprising:

bias circuitry for setting a level of current through each light emitting device;

the light emitting devices to be connected in circuit with the output node and bias circuitry; and control circuitry configured for controlling an operating voltage across the bias circuitry to be substantially a lowest output voltage effective to drive one of the light emitting devices having the highest forward voltage drop; and a voltage regulator configured, responsive to the control circuitry, for selectively increasing and decreasing an output voltage to be applied to the output node so as to maintain the operating voltage to be substantially the lowest output voltage.

69. A method for driving multiple light emitting devices connected in parallel to an output node and each connected in series to respective bias circuits for biasing the light emitting devices, the method comprising the steps of:

receiving signals from the respective bias circuits, detecting which one of the light emitting devices being biased has the highest forward voltage drop based on the signals;

generating a control signal to cause an output voltage to be applied to the output node to attain the lowest voltage so as to drive that one of the light emitting devices having the highest forward voltage drop; and responsive to the control signal, selectively increasing and decreasing the output voltage to regulate the output voltage.

70. The circuitry according to claim 2, wherein each bias circuit comprises a transistor having a control terminal, and first and second terminals coupled between a corresponding light emitting device and ground, and the corresponding node in each bias circuit is the control terminal of the transistor.

71. The circuit according to claim 2, wherein each bias circuit comprises a MOS transistor, and the corresponding node in each bias circuit is the gate of the MOS transistor.

72. The circuitry according to claim 9, wherein each bias circuit comprises a transistor having a control terminal, and first and second terminals, the first terminal of which is coupled to a corresponding light emitting device and the second terminal of which is directly grounded, and the voltage at the node is a voltage only between the first and second terminals of the transistor.

73. The circuitry according to claim 72, wherein the transistor is a MOS transistor, the first terminal is a drain, and the second terminal is a source.

74. The circuitry according to claim 73, wherein each bias circuit comprises a current mirror circuit including the MOS transistor, the current mirror circuit being configured for mirroring a reference current to cause a program current to flow through the corresponding light emitting device.

75. The circuitry according to claim 21, wherein each bias circuit comprises a transistor having a control terminal, and first and second terminals coupled between a corresponding light emitting device and ground, and the corresponding node in each bias circuit is the control terminal of the transistor.

76. The circuit according to claim 21, wherein each bias circuit comprises a MOS transistor, and the corresponding node in each bias circuit is the gate of the MOS transistor.

77. The circuitry according to claim 28, wherein each bias circuit comprises a transistor having a control terminal, and first and second terminals, the first terminal of which is coupled to a corresponding light emitting device and the second terminal of which is directly grounded, and the voltage at the node is a voltage only between the first and second terminals of the transistor.

78. The circuitry according to claim 77, wherein the transistor is a MOS transistor, the first terminal is a drain, and the second terminal is a source.

79. The circuitry according to claim 78, wherein each bias circuit comprises a current mirror circuit including the MOS transistor, the current mirror circuit being configured for mirroring a reference current to cause a program current to flow through the corresponding light emitting device.

80. The circuitry according to claim 40, wherein each bias circuit comprises a transistor having a control terminal, and first and second terminals coupled between a corresponding light emitting device and ground, and the corresponding node in each bias circuit is the control terminal of the transistor.

81. The circuit according to claim 40, wherein each bias circuit comprises a MOS transistor, and the corresponding node in each bias circuit is the gate of the MOS transistor.

82. The circuitry according to claim 43, wherein each bias circuit comprises a transistor having a control terminal, and first and second terminals, the first terminal of which is coupled to a corresponding light emitting device and the second terminal of which is directly grounded, and the voltage at the node is a voltage only between the first and second terminals of the transistor.

83. The circuitry according to claim 82, wherein the transistor is a MOS transistor, the first terminal is a drain, and the second terminal is a source.

84. The circuitry according to claim 83, wherein each bias circuit comprises a current mirror circuit including the MOS transistor, the current mirror circuit being configured for mirroring a reference current to cause a program current to flow through the corresponding light emitting device.

85. The method according to claim 49, wherein each bias circuit comprises a transistor having a control terminal, and first and second terminals coupled between a corresponding light emitting device and ground, and the corresponding node in each bias circuit is the control terminal of the transistor.

86. The method according to claim 49, wherein each bias circuit comprises a MOS transistor, and the corresponding node in each bias circuit is the gate of the MOS transistor.

87. The method according to claim 55, wherein each bias circuit comprises a transistor having a control terminal, and first and second terminals, the first terminal of which is coupled to a corresponding light emitting device and the second terminal of which is directly grounded, and the voltage at the node is a voltage only between the first and second terminals of the transistor.

88. The method according to claim 87, wherein the transistor is a MOS transistor, the first terminal is a drain, and the second terminal is a source.

89. The method according to claim 88, wherein each bias circuit comprises a current mirror circuit including the MOS transistor, the current mirror circuit being configured for mirroring a reference current to cause a program current to flow through the corresponding light emitting device.

90. The circuitry according to claim 64, wherein each bias circuit comprises a transistor having a control terminal, and first and second terminals coupled between a corresponding light emitting device and ground, and the corresponding node in each bias circuit is the control terminal of the transistor.

91. The circuit according to claim 64, wherein each bias circuit comprises a MOS transistor, and the corresponding node in each bias circuit is the gate of the MOS transistor.

92. The circuitry according to claim 65, wherein each bias circuit comprises a transistor having a control terminal, and first and second terminals, the first terminal of which is coupled to a corresponding light emitting device and the second terminal of which is directly grounded, and the voltage at the node is a voltage only between the first and second terminals of the transistor.

93. The circuitry according to claim 92, wherein the transistor is a MOS transistor, the first terminal is a drain, and the second terminal is a source.

94. The circuitry according to claim 93, wherein each bias circuit comprises a current mirror circuit including the MOS transistor, the current mirror circuit being configured for mirroring a reference current to cause a program current to flow through the corresponding light emitting device.

* * * * *